US009114312B2

(12) United States Patent
Liao

(10) Patent No.: US 9,114,312 B2
(45) Date of Patent: Aug. 25, 2015

(54) MULTI-FUNCTIONAL DEVICE FOR A TOY GUN

(75) Inventor: Yin-Hsi Liao, New Taipei (TW)

(73) Assignee: Guay Guay Trading Co., Ltd., New Taipei (TW)

( * ) Notice: Subject to any disclaimer, the term of this patent is extended or adjusted under 35 U.S.C. 154(b) by 265 days.

(21) Appl. No.: 13/293,129

(22) Filed: Nov. 10, 2011

(65) Prior Publication Data

US 2013/0122470 A1 May 16, 2013

(51) Int. Cl.

| | |
|---|---|
| ***F41A 33/00*** | (2006.01) |
| ***A63F 9/02*** | (2006.01) |
| ***F41A 19/01*** | (2006.01) |
| ***F41A 33/02*** | (2006.01) |
| ***F41G 3/26*** | (2006.01) |

(52) U.S. Cl.

CPC . *A63F 9/02* (2013.01); *F41A 19/01* (2013.01); *F41A 33/02* (2013.01); *F41G 3/2655* (2013.01)

(58) Field of Classification Search

CPC ... A63F 2300/8076; A63F 9/02; A63F 13/04; A63F 9/0278; A63F 9/0252; F41G 11/00

USPC ..... 434/11–27

See application file for complete search history.

(56) References Cited

U.S. PATENT DOCUMENTS

2005/0017456 A1* 1/2005 Shechter ..... 273/371
2009/0241357 A1* 10/2009 Raschella et al. ..... 33/228

* cited by examiner

*Primary Examiner* — Timothy A Musselman
(74) *Attorney, Agent, or Firm* — Leong C. Lei

(57) ABSTRACT

A device for a toy gun is adapted for connection to the front end of the barrel of a toy gun. The device comprises a laser unit including a sighting means and a firing means, so that the firing accuracy of the toy gun can be increased. Also, the device can measure the speed of a projectile fired from the toy gun, the total number of projectiles that have been fired from the toy gun, so that a player can adjust the toy gun or replace the magazine of projectiles at an appropriate time.

4 Claims, 15 Drawing Sheets

MULTI-FUNCTIONAL DEVICE FOR A TOY GUN

TECHNICAL FIELD OF THE INVENTION

The present invention relates to a multi-functional device for a toy gun, and more particularly to a device that contains a laser unit including a sighting means and a firing means, and various functions.

DESCRIPTION OF THE PRIOR ART

Combat games have become a popular recreation activity, in which people are teamed and toy guns are employed to simulate a real war. The game can foster mutual understanding among people and achieve an effect of entertainment.

To have a good result in a combat game, every player should practice shooting before the game to increase the accuracy of firing a target. For increasing the firing accuracy, a toy gun may be mounted with an infrared sight device. The firing accuracy can be improved through the sight device. However, a player often forget the number of projectiles remained in the gun, and thus the player would be at an awkward situation when the projectiles remained in the gun is insufficient. Besides, the infrared sight device cannot have an effect of saving electrical power, although it can be recharged. Regarding various auxiliary devices for toy guns, they are only with the function of sighting a target and do not contain other advanced functions, such as the speed measurement for projectiles, the counting of the number of projectiles being fired, laser weapon simulation. Thus, there is a need to develop a device having more functions to assist the toy guns in playing a combat game or practicing a shooting.

SUMMARY OF THE INVENTION

The primary object of the present invention is to provide a device for a toy gun, which can project a coded laser beam to an impact point of a projectile fired from the gun and contains various functions.

To achieve the above object, the device comprises a control circuit board, a speed measuring means, a counting means, a memory means, and a laser unit. The speed measuring means is electrically connected with the control circuit board for measuring the speed of a projectile fired from the toy gun. The counting means is electrically connected with the control circuit board for counting the total number of the projectiles having been fired from the toy gun. The memory means is connected with the speed measuring means and the counting means for storing data. The laser unit is electrically connected with the control circuit board. The laser unit includes a sighting means and a firing means. The sighting means is capable of projecting a laser beam to a target. The firing means is capable of sensing a projectile fired from the toy gun and thereafter projecting a coded laser beam to the target.

Another object of the present invention is to provide a device for a toy gun, which further comprises a power supply unit and a power saving means, in which the power supply unit is used for supplying all of the components of the device with suitable powers to allow each to have a normal operation; the power saving means is electrically connected to the power supply unit for controlling electrical output of the power supply unit so that electrical power can be used effectively.

A further object of the present invention is to provide a device for a toy gun, which allow players to know the projectiles remained in the gun and the speeds of the projectiles fired from the gun, so that they can replace the magazine of projectiles or adjust the toy gun in time.

A still further object of the present invention is to provide a device for a toy gun, which is simple in structure and can be easily mounted to the gun.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
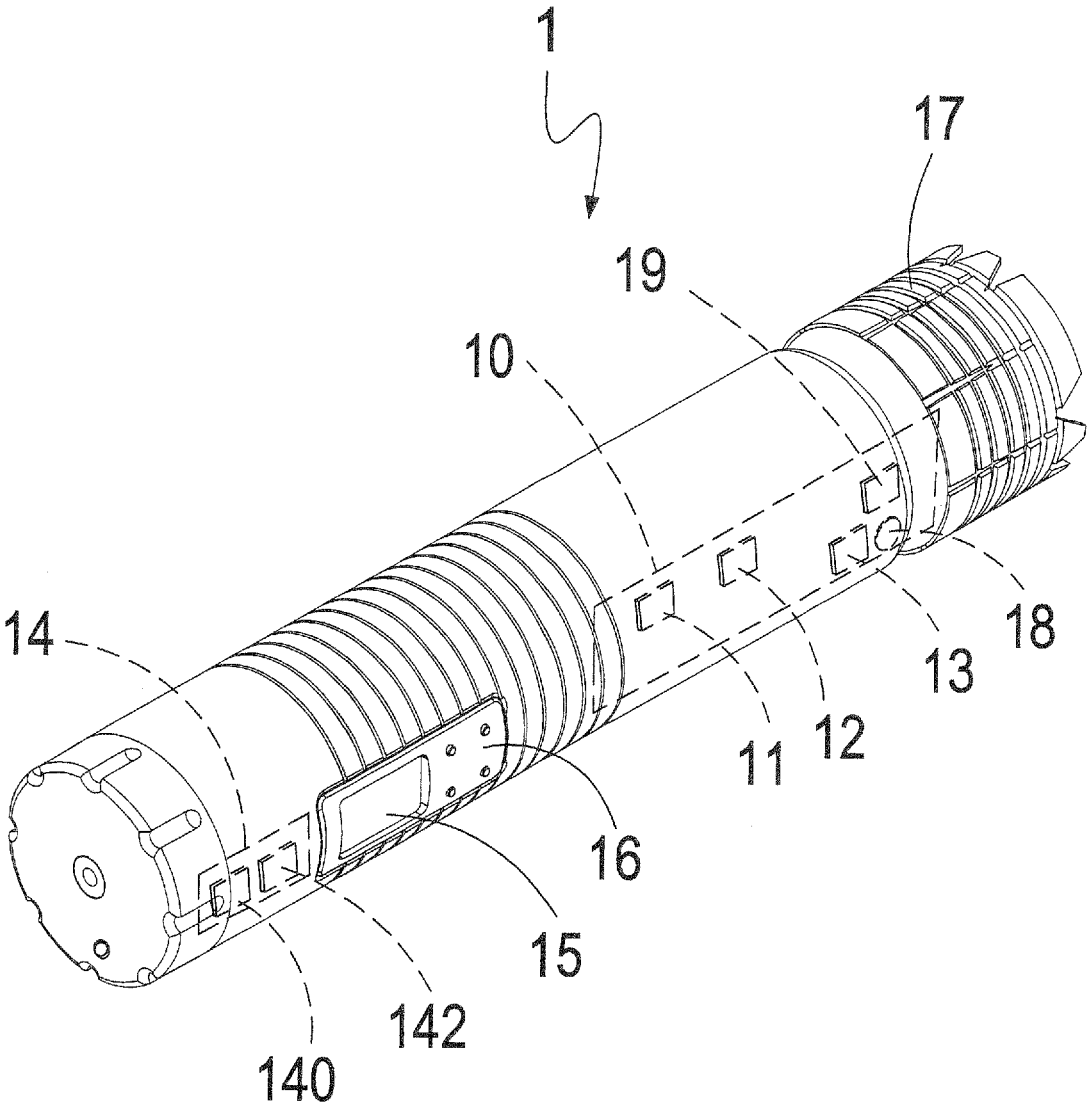
FIG. 1 schematically shows a 3-dimensional view of a preferred embodiment of the present invention.

Turning now to FIGS. 1, 2, 3, 3A, 4, and 4A, one embodiment of a multi-functional device for a toy gun is illustrated. The device is indicated at reference numeral 1. The device 1 can be mounted to the front end of the barrel 3 of the toy gun. The device 1 generally comprises a control circuit 10, a speed measuring means 11, a counting means 12, a memory means 13, and a laser unit 14. The speed measuring means 11 is electrically connected with the control circuit board 10 for measuring the speed of a projectile 2 fired from the toy gun. The memory means 13 is connected with the control circuit board 10 for storing data. The laser unit 14 is electrically connected with the control circuit board 10. The laser unit 14 includes a sighting means 140 and a firing means 142. The sighting means 140 is capable of projecting a laser beam to a target. The firing means 142 is capable of sensing a projectile fired from the toy gun and thereafter projecting a coded laser beam to the target. The device 1 may further comprise a display 15 for showing data and an operational panel 16 electrically connected with the control circuit board 10 for setting data. Furthermore, the device 1 is provided with a coupling member 17 adapted for connection to the front end of the barrel 3 of the toy gun (see FIG. 2).

Figure 2:
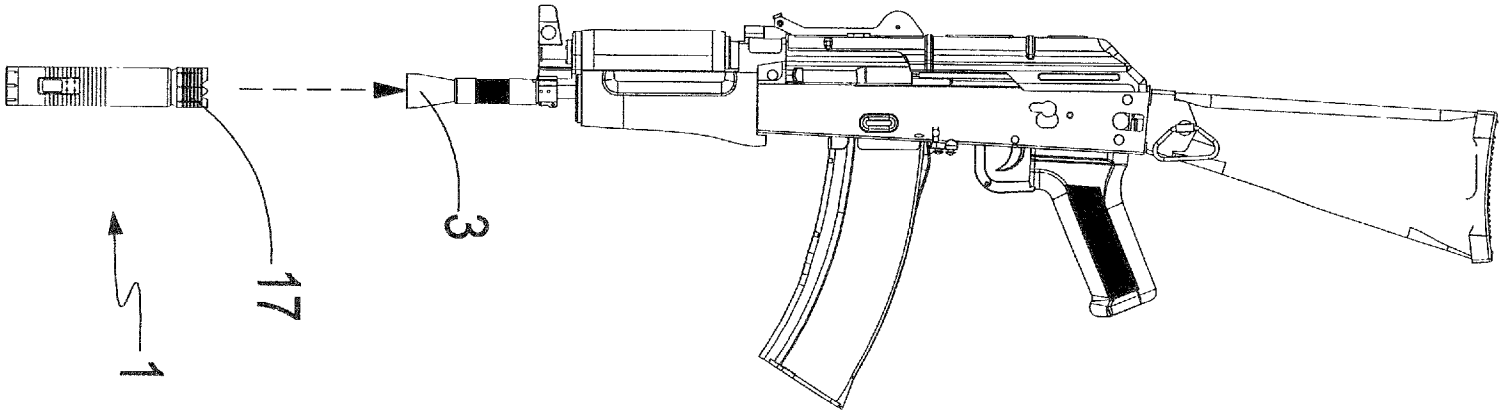
FIG. 2 schematically shows a plan view of the embodiment that is being coupled to a toy gun.
Figure 3:
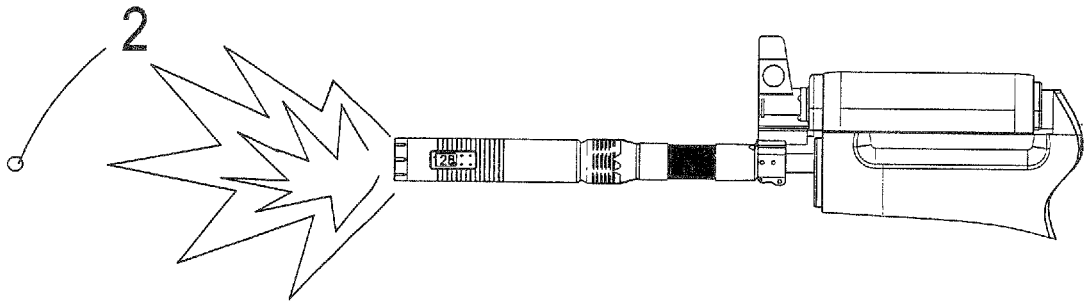
FIG. 3 schematically shows a plan view of the embodiment that can measure the speed of a projectile fired from a toy gun.
Figure 3A:
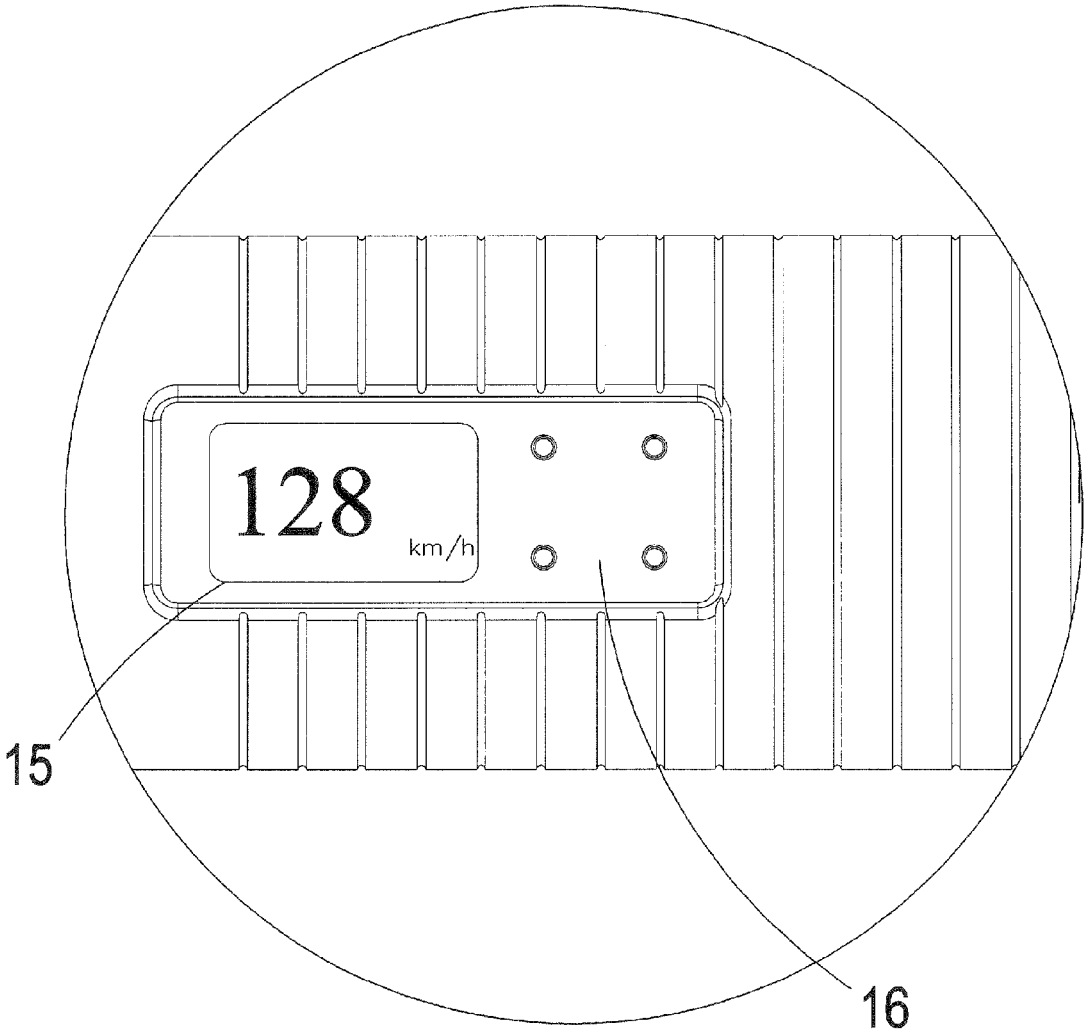
FIG. 3A is a plan view of the embodiment, in which the display thereof is showing the speed of a projectile fired from a toy gun.
Figure 4:
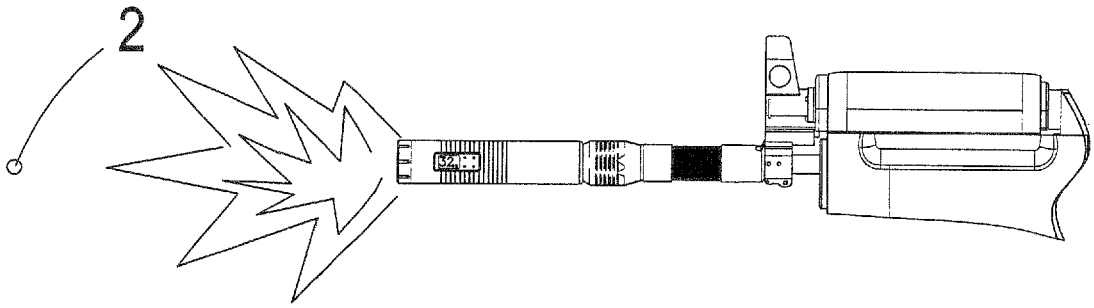
FIG. 4 schematically shows a plan view of the embodiment that can count the number of the projectiles having been fired from a toy gun.
Figure 4A:
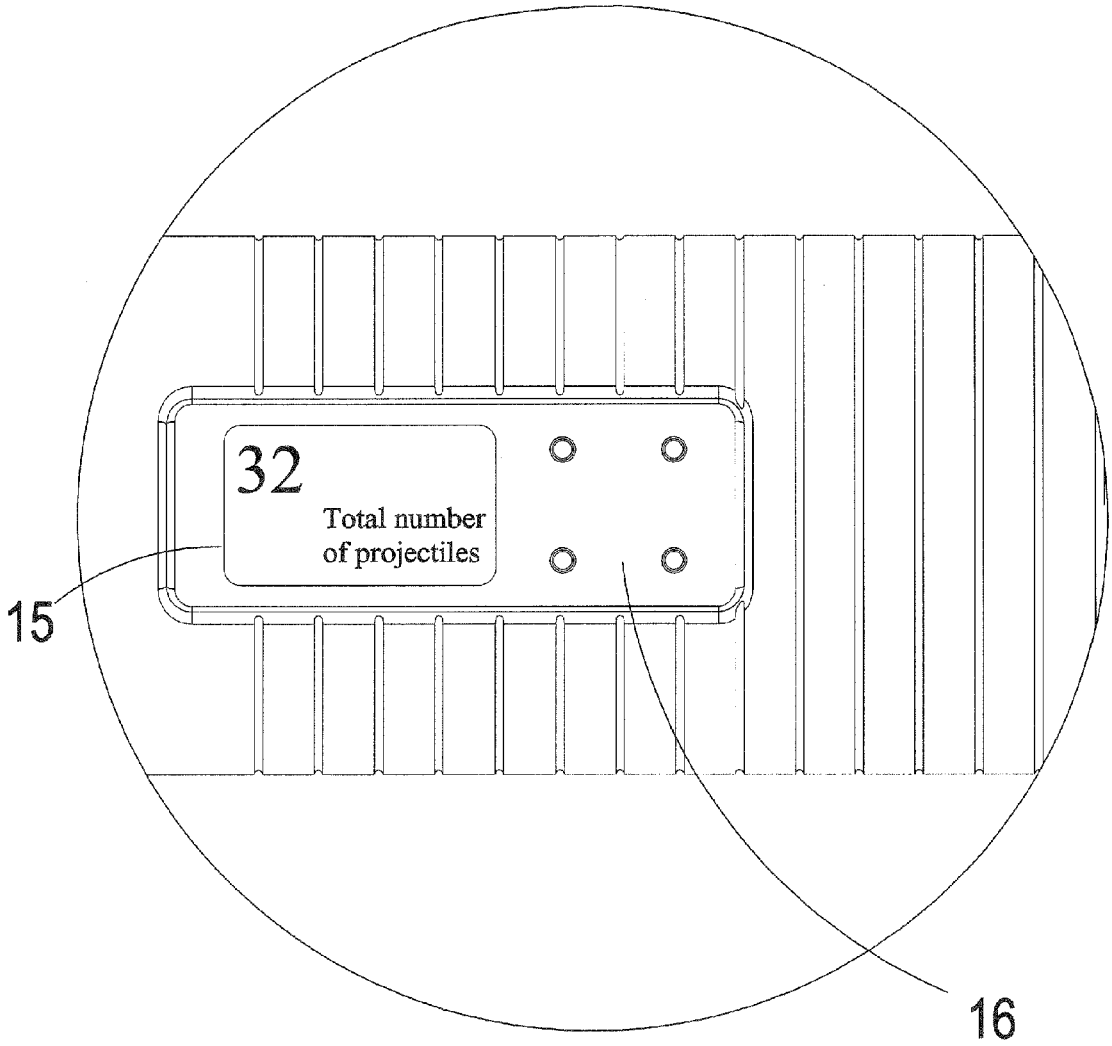
FIG. 4A is a plan view of the embodiment, in which the display thereof is showing the total number of the projectiles having been fired from a toy gun.

In use, the device 1 can be coupled to the front end of the barrel 3 of the toy gun by using the coupling member 17 (see FIG. 2). When a player fires the toy gun, as shown in FIG. 1, the speed measuring means 11 and the counting means 12 will sense a projectile 2 from the barrel 3. The sensed signals will be sent to the control board 10 for data operations, so that the speed of the projectile 2 can be measured and stored in the memory means 13 via the circuit board 10, and the total number of the projectiles having been fired from the toy gun can be stored in the memory means 13 via the circuit board 10. In addition, the speed of the projectile and the total number of the projectiles will be shown on the display 15 so that the player may know the status of the toy gun (see FIGS. 3A and 4A).

Figure 5:
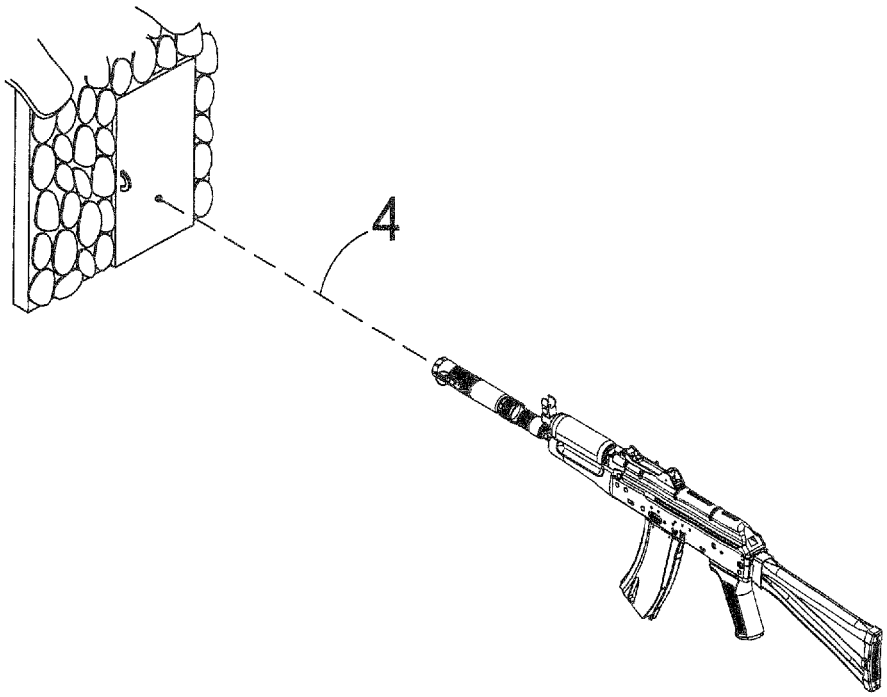
FIG. 5 schematically shows an operating state of the embodiment, in which the sighting means of the laser unit is projecting a laser beam to a target.
Figure 5A:
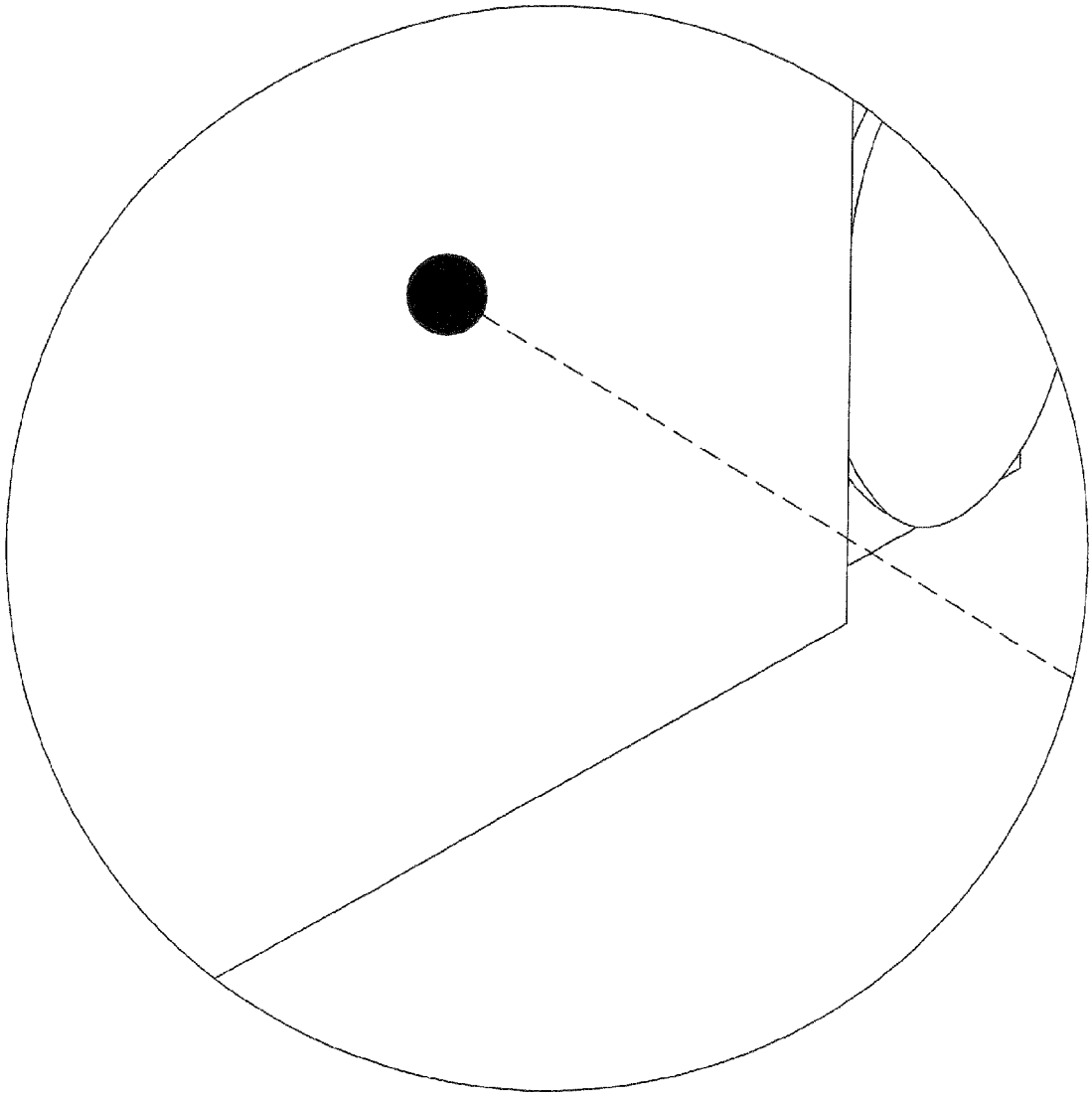
FIG. 5A schematically shows a partially enlarged view of the operating state of the embodiment shown in FIG. 5.
Figure 5B:
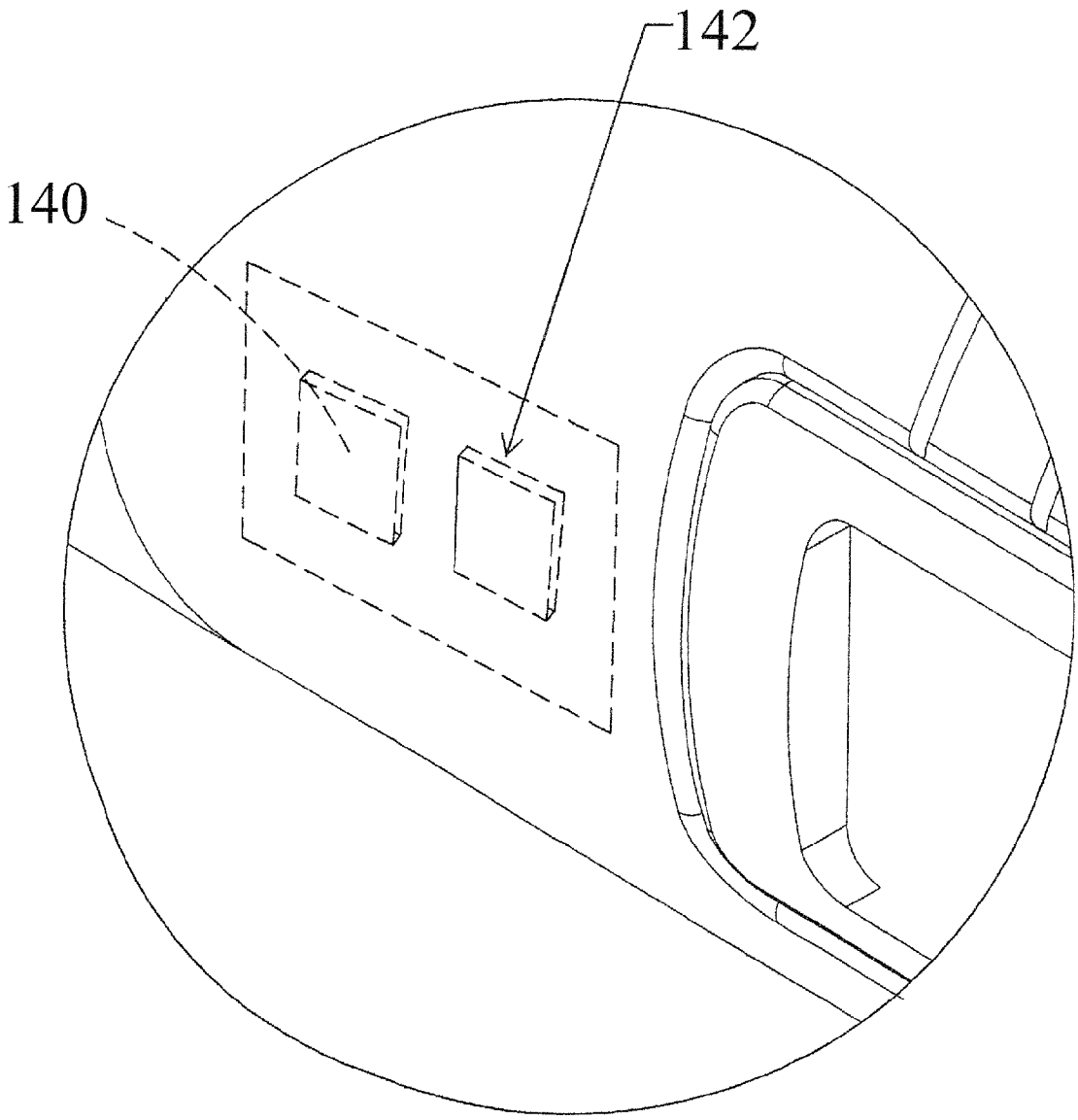
FIG. 5B schematically shows a partially enlarged view of the sighting means of the laser unit of the embodiment.

Additionally, as shown in FIGS. 5, 5A and 5B, through the sighting means 140 of the laser unit 14, a player can project a light beam 4, such as an infrared laser beam, to a target to allow a light spot to be appeared on the target, so that the accuracy of the firing may be increased.

Figure 6:
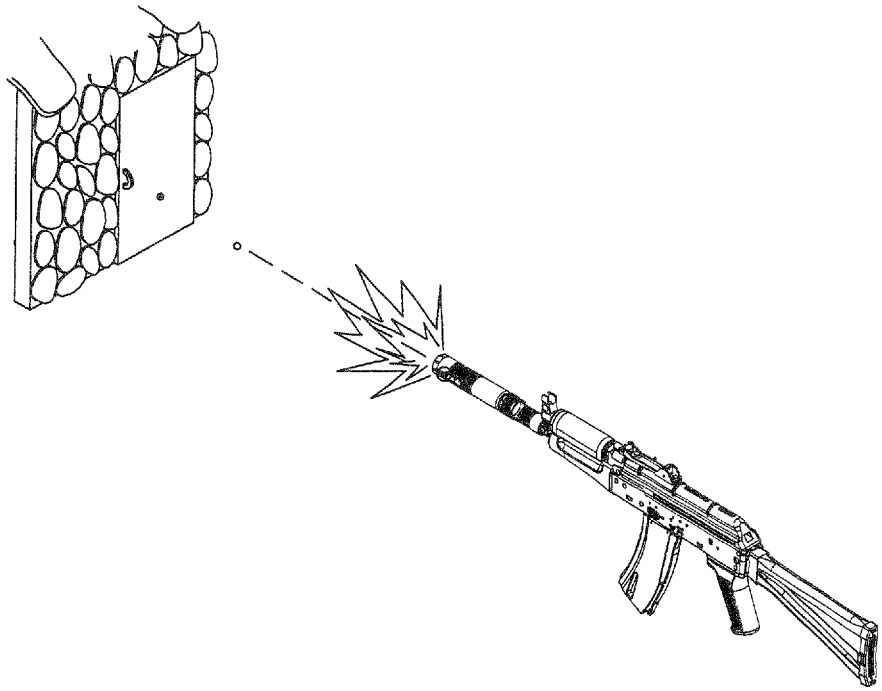
FIG. 6 schematically shows an operating state of the embodiment, in which the firing means of the laser unit is projecting a coded laser beam to a target.
Figure 6A:
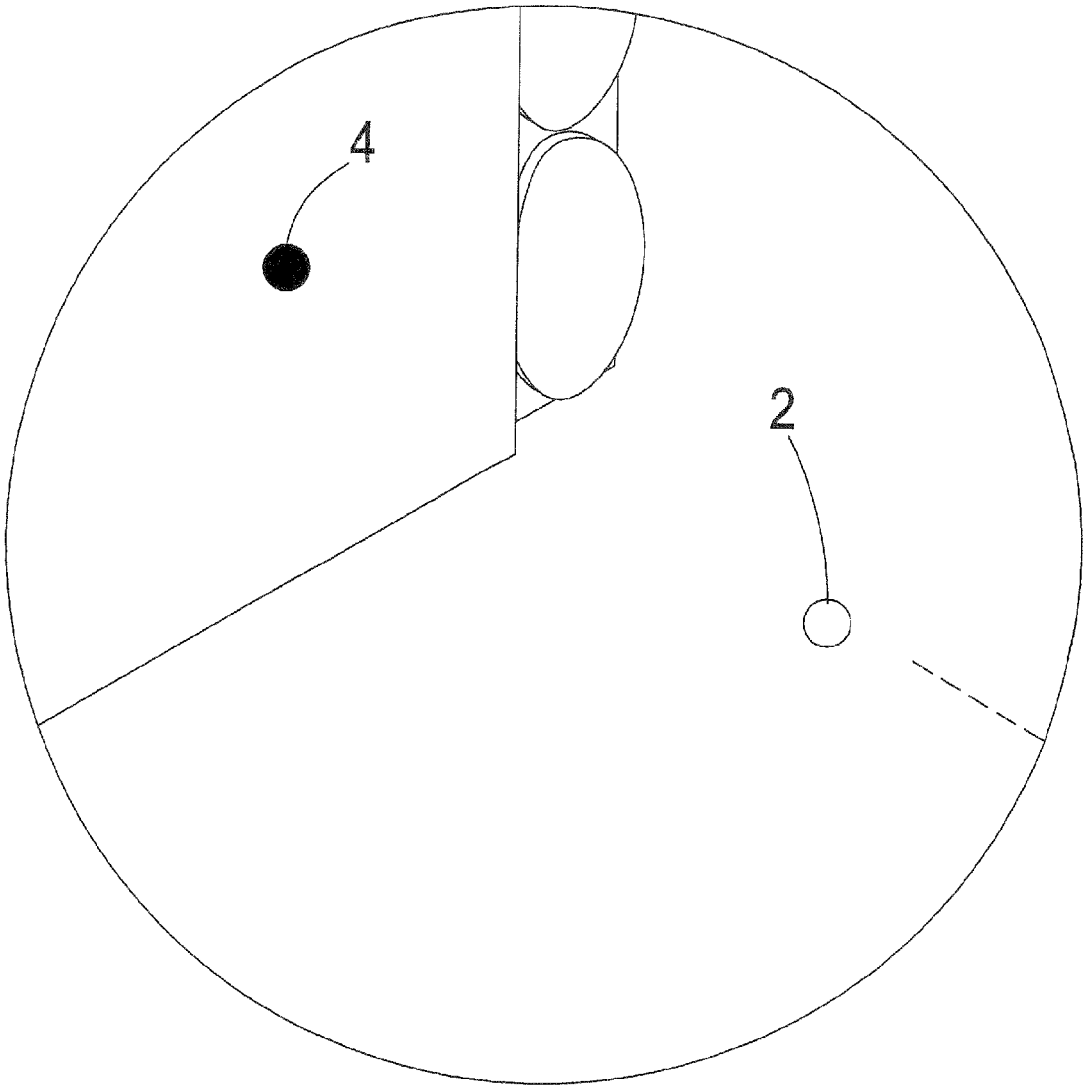
FIG. 6A schematically shows a partially enlarged view of the operating state of the embodiment shown in FIG. 6.
Figure 6B:
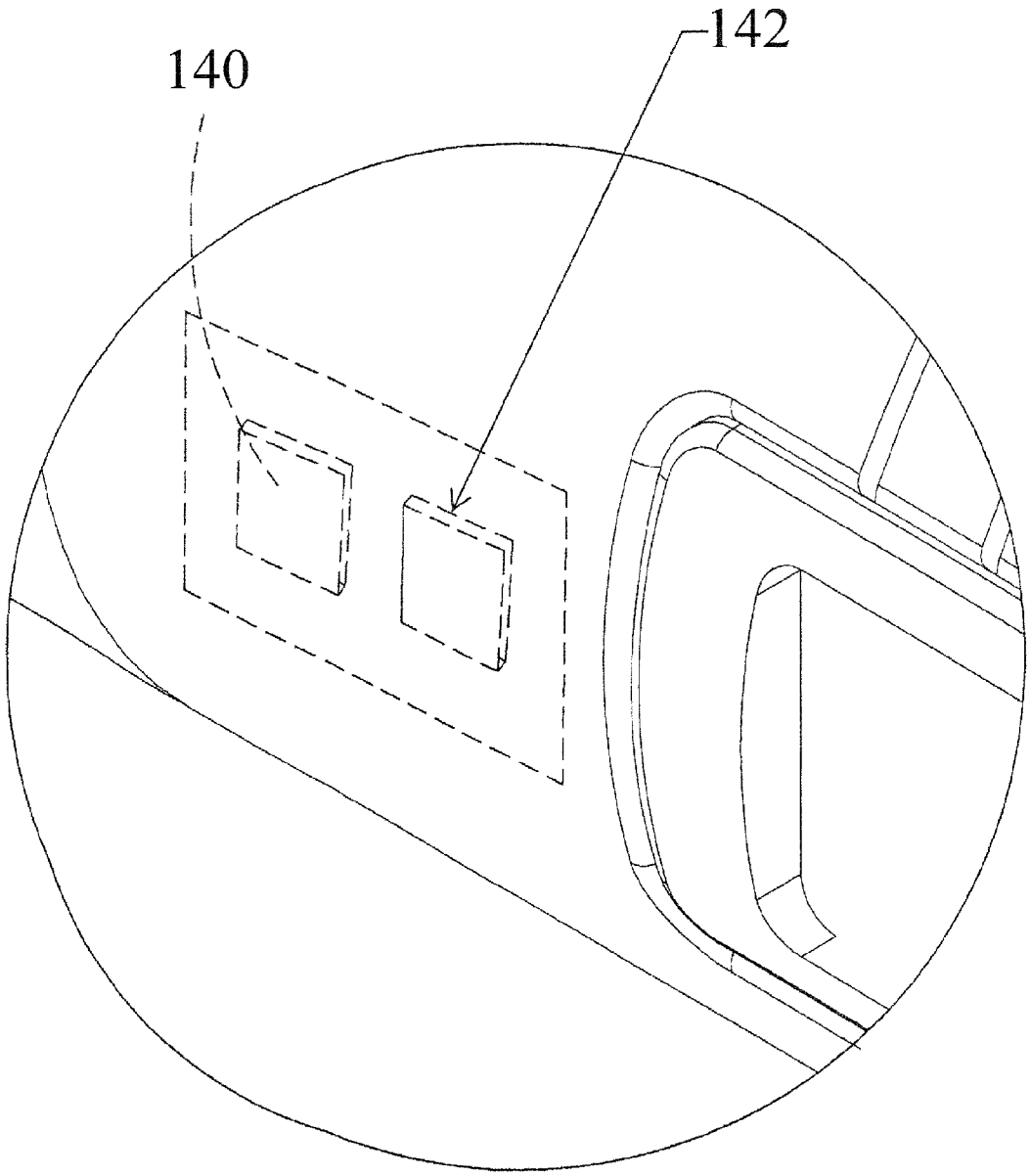
FIG. 6B schematically shows a partially enlarged view of the firing means of the laser unit of the embodiment

As shown in FIGS. 6, 6A and 6B, at the moment of the projectile 2 entering the device 1, the firing means 142 of the laser unit 14 can project a coded laser beam to a point of the target that the projectile 2 would impact. The firing means 142 of the laser unit 14 will stop the projection of the coded laser beam after the firing is completed and the projectile 2 has passed the device 1. The number of the projections of coded laser beam will be the same as the total number of the projectiles having been fired from the barrel 3. Such manner of projecting a coded laser beam to a target can simulate an operating condition of laser ammunition, and can be employed as a way for a long-range or middle-range shooting training. Furthermore, through the operational panel 16, various configurations of data may be set for the device 1, so that the device 1 can be applied with a variety of modes.

Figure 7:
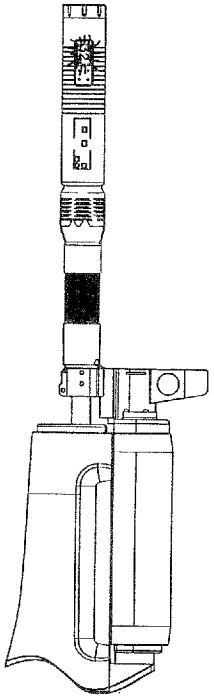
FIG. 7 shows an operating state of the embodiment, in which the power saving means can control electrical output of the power supply unit.
Figure 7A:
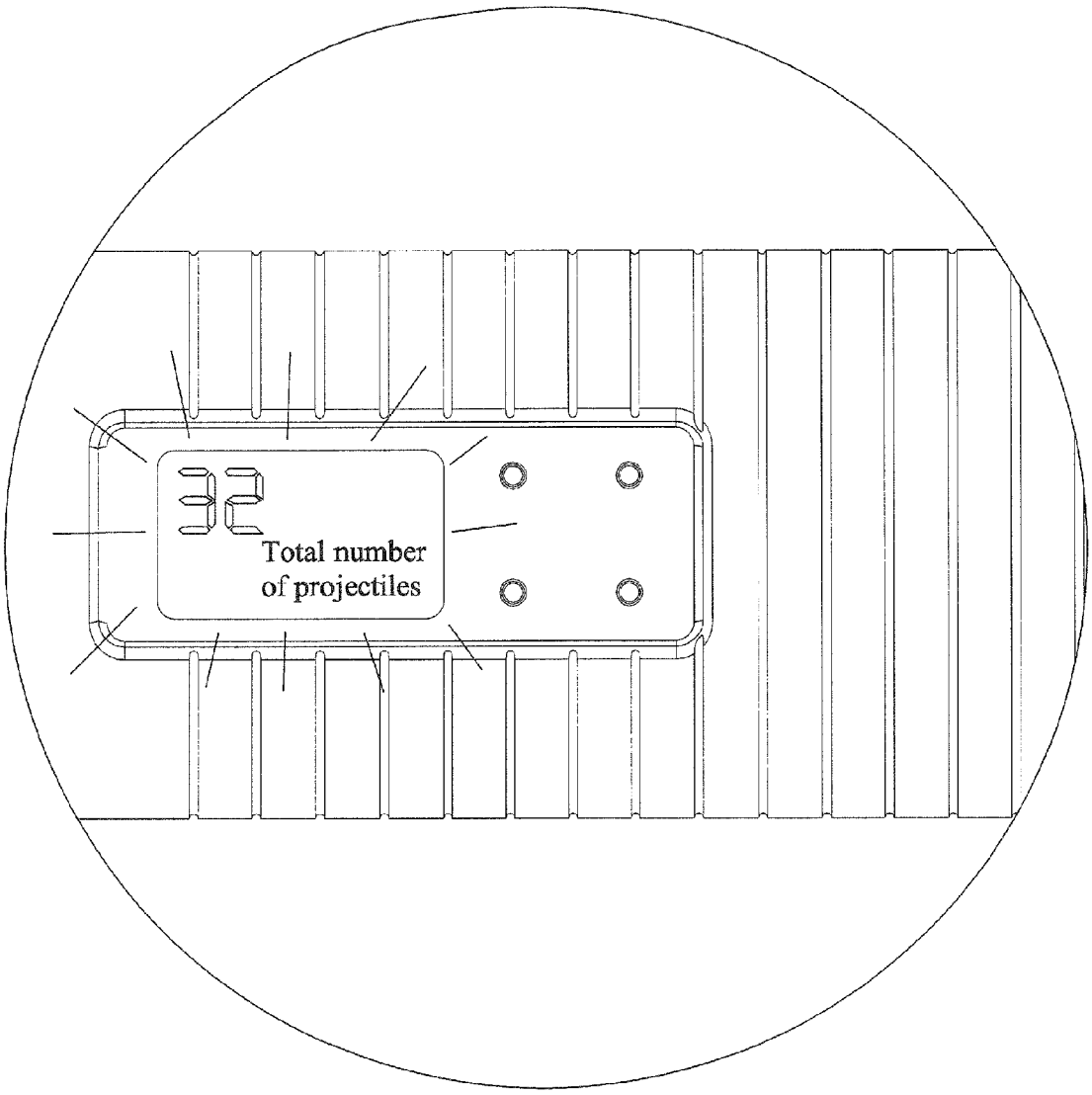
FIG. 7A schematically shows an operating state of the embodiment when the power saving means is used with the power supply unit.
Figure 7B:
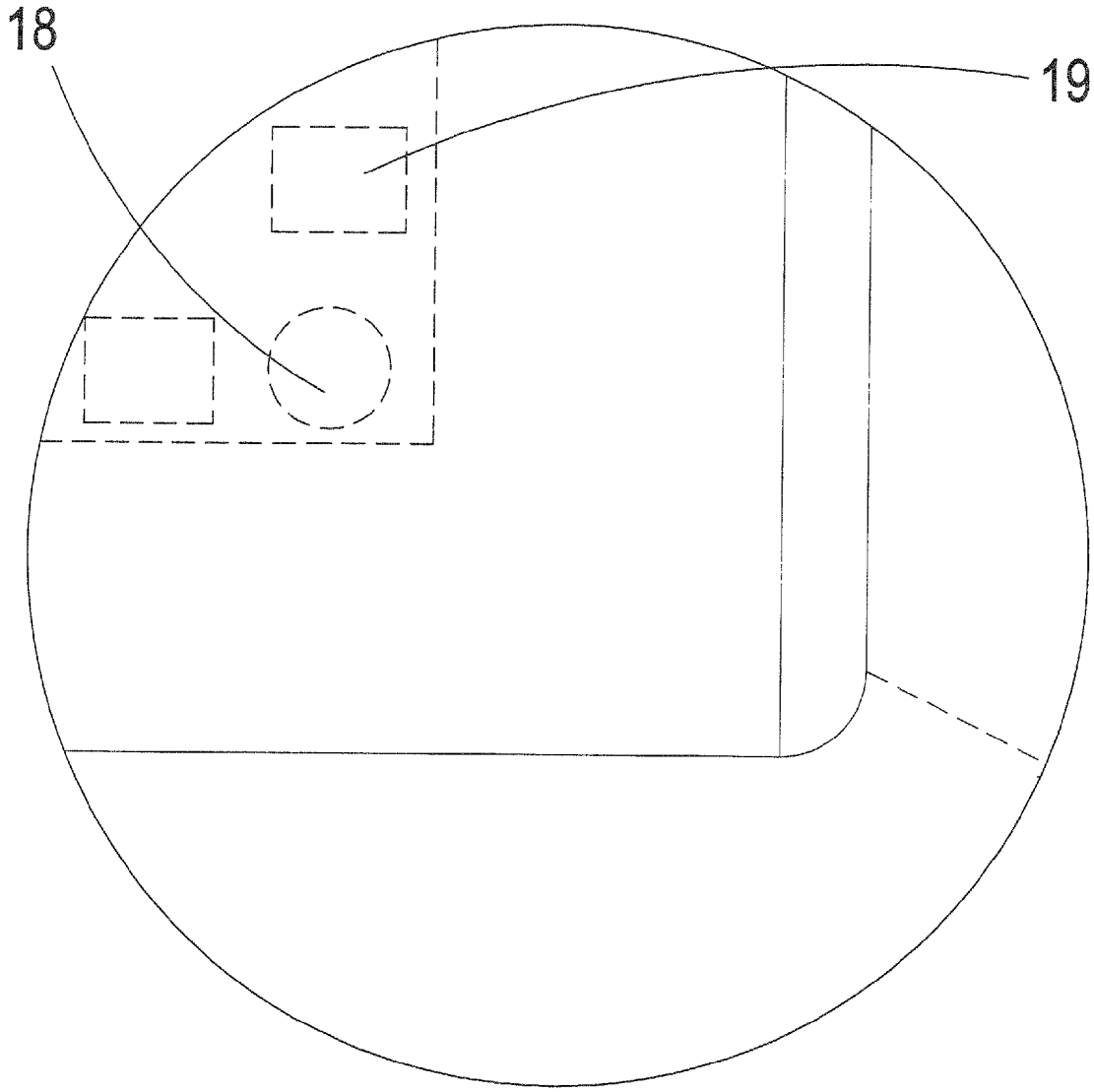
FIG. 7B schematically shows a partially enlarged view of the power saving means of the embodiment.

As shown in FIGS. 7, 7A and 7B, the device 1 is provided with a power supply unit 18 and a power saving means 19. The power supply unit 18 can supply all the components of the device 1 with suitable powers to allow each to have a normal operation. The power saving means 19 is electrically connected to the power supply unit 18 for controlling electrical output of the power supply unit 18, so that electrical power can be used effectively. When the toy gun is in use, the power required for the device 1 can be supplied from the power supply unit 18. The power supply unit 18 can supply sufficient power for each component of device 1, so that the measurements and operations for projectile 2 can be conducted by respective components of the device 1 to allow the associated data to be shown on the display 15. When the toy gun is in idle for more than a predetermined time, the power supply unit 18 will be automatically turned off by the power saving means 19 to save electrical power. The player need not pay attention to whether the power is turned off.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A multi-functional device for a toy gun, the device comprising:

a coupling member for allowing the device to be coupled to a front end of a barrel of the toy gun;

a control circuit board;

a counting means electrically connected with said control circuit board for counting the total number of the projectiles having been fired from the toy gun;

a display electrically connected with said control circuit board for showing data;

a memory means electrically connected with said control circuit board for storing data; and a laser unit electrically connected with said control circuit board, said laser unit including:

a sighting means capable of projecting a laser beam to a target; and a firing means capable of sensing a projectile fired from the toy gun and thereafter projecting a coded laser beam to the target; whereby the device shows the total number and the speed of the projectiles fired from the toy gun, and said firing means simulate a laser weapon.

2. A multi-functional device for a toy gun as claimed in claim 1, further comprising an operational panel electrically connected with said control circuit board for setting data.

3. A multi-functional device for a toy gun as claimed in claim 2, wherein the target is provided with a laser receiver, which detects a coded laser beam projected by said firing means, to confirm whether the target was shot accurately.

4. A multi-functional device for a toy gun as claimed in claim 3, further comprising a power supply unit for supplying all of the above components with powers, and a power saving means electrically connected to said power supply unit for controlling electrical output of said power supply unit.

* * * * *